US008584632B2

(12) United States Patent
Stiegler et al.

(10) Patent No.: US 8,584,632 B2
(45) Date of Patent: Nov. 19, 2013

(54) VALVE TRAIN FOR INTERNAL COMBUSTION ENGINES FOR ACTUATING GAS EXCHANGE VALVES

(75) Inventors: Lutz Stiegler, Kaendler (DE); Andreas Werler, Zwickau (DE); Joerg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 3 days.

(21) Appl. No.: 13/472,636

(22) Filed: May 16, 2012

(65) Prior Publication Data

US 2012/0291734 A1 Nov. 22, 2012

(30) Foreign Application Priority Data

May 16, 2011 (DE) ..... 10 2011 101 871

(51) Int. Cl.
*F01L 1/34* (2006.01)

(52) U.S. Cl.
USPC ..... 123/90.16; 123/90.39

(58) Field of Classification Search
USPC ..... 123/90.16, 90.39; 74/559
See application file for complete search history.

(56) References Cited

U.S. PATENT DOCUMENTS

| | | | | |
|---|---|---|---|---|
| 3,878,822 | A * | 4/1975 | Beal | 123/90.16 |
| 4,151,817 | A | 5/1979 | Mueller | |
| 4,353,334 | A | 10/1982 | Neitz | |
| 4,354,460 | A | 10/1982 | Mae et al. | |
| 4,516,542 | A | 5/1985 | Aoyoma et al. | |
| 4,534,323 | A | 8/1985 | Kato et al. | |
| 6,915,768 | B2 | 7/2005 | Ohsawa | |
| 2008/0236531 | A1 | 10/2008 | Yamamoto et al. | |

FOREIGN PATENT DOCUMENTS

| | | | |
|---|---|---|---|
| DE | 3319755 | A1 | 12/1983 |
| DE | 4230877 | A1 | 4/1993 |
| DE | 19520117 | A1 | 12/1996 |
| DE | 19700736 | A1 | 7/1998 |
| DE | 102004022849 | A1 | 12/2005 |
| DE | 102004056290 | A1 | 6/2006 |
| DE | 102009007263 | A1 | 8/2010 |
| EP | 2196638 | A1 | 6/2010 |
| JP | 55131515 | A | 10/1980 |
| JP | 2003003811 | A | 1/2003 |
| JP | 2005155555 | A | 6/2005 |

* cited by examiner

*Primary Examiner* — Zelalem Eshete
(74) *Attorney, Agent, or Firm* — Leydig, Voit & Mayer, Ltd.

(57) ABSTRACT

A valve train device for switching a lift of gas exchange valves of an internal combustion engine includes a camshaft. A cam group includes at least two cams disposed on the camshaft. At least one lever is mounted axially displaceably relative to the camshaft and is in contact with one of the at least two cams and includes an actuation region for a direct or indirect actuation of at least one gas exchange valve. An adjustment unit is operatively connected to the lever so as to displace the lever. The unit includes at least one rotatable adjustment shaft, at least one sleeve having at least one guide track mounted on the shaft non-rotationally and axially displaceably, an engagement element fixed to a housing and engaging permanently in the at least one guide track and supporting the at least one sleeve with respect to the housing, and a further engagement element.

15 Claims, 1 Drawing Sheet

VALVE TRAIN FOR INTERNAL COMBUSTION ENGINES FOR ACTUATING GAS EXCHANGE VALVES

CROSS-REFERENCE TO PRIOR APPLICATIONS

Priority is claimed to German Patent Application No. DE 10 2011 101 871.2, filed on May 16, 2011, the entire disclosure of which is hereby incorporated by reference herein.

FIELD

The present invention relates to a valve train device for gas exchange valves of internal combustion engines.

BACKGROUND

Valve train devices may have an apparatus for switching the lift of gas exchange valves.

A variable valve train is described in US patent specification U.S. Pat. No. 4,354,460, in which a displaceable rocker arm is provided so as to switch between two axially adjacent cams having different cam contours for actuation of the associated gas exchange valve. To this end, a hydraulic unit is provided, with which the rocker arm can be axially displaced on a rocker arm shaft arranged parallel to the camshaft. To this end, a hydraulic piston is provided, to which hydraulic pressure can be applied alternately and which moves a piston rod fastened to the piston. The piston rod is guided within the rocker arm shaft and is connected to the respective rocker arm via recesses. Spring assemblies are arranged on the piston rod and temporarily store the energy for switching the rocker arm until the axial displacement of the rocker arm is released. Each rocker arm of an internal combustion engine is thus displaced axially by means of a plurality of cylinders upon actuation of the hydraulic piston at an accordingly predefined moment in time during encroachment of the base circle overlapping the cams. To actuate the gas exchange valve, a bucket tappet is used, of which the diameter corresponds at least to the displacement path of the rocker arm so that the rocker arm contacts the bucket tappet in each switching position and can thus actuate the gas exchange valve.

Patent specification DE 33 19 755 C2 describes a valve actuation/switching apparatus for an internal combustion engine, in which the two cams, each associated with a gas exchange valve, are partitioned to reduce the necessary switching path of the rocker arm. Each of the two cams is therefore partitioned into two sub-cams. Due to the alternating arrangement of the partitioned cams, the axial displacement of the rocker arm on the rocker arm shaft provided therefor eon be reduced by half of the original cam width. The overall space is thus reduced.

SUMMARY OF THE INVENTION

In an embodiment, the present invention provides a valve train device for switching a lift of gas exchange valves of an internal combustion engine including a camshaft. A cam group includes at least two cams disposed on the camshaft. At least one lever is mounted displaceably relative to the camshaft and is in contact with one of the at least two cams and includes an actuation region for a direct or indirect actuation of at least one gas exchange valve. An adjustment unit is operatively connected to the lever so as to displace the lever. The adjustment unit includes at least one rotatable adjustment shaft, at least one sleeve having at least one guide track mounted on the shaft non-rotationally and axially displaceably, an engagement element fixed to a housing and engaging permanently in the at least one guide track and supporting the at least one sleeve with respect to the housing, and a further engagement element offset radially along the guide track with respect to the engagement element and engaging permanently in the at least one guide track and connected rigidly to the lever.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
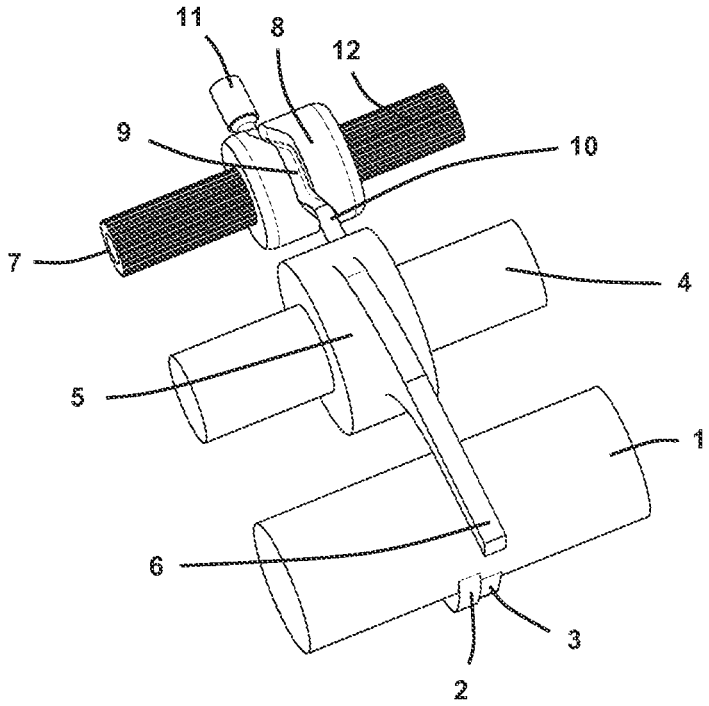
FIG. 1 shows a schematic illustration of an embodiment of the valve train device according to the invention with an adjustment shaft spaced apart in parallel.
Figure 2:
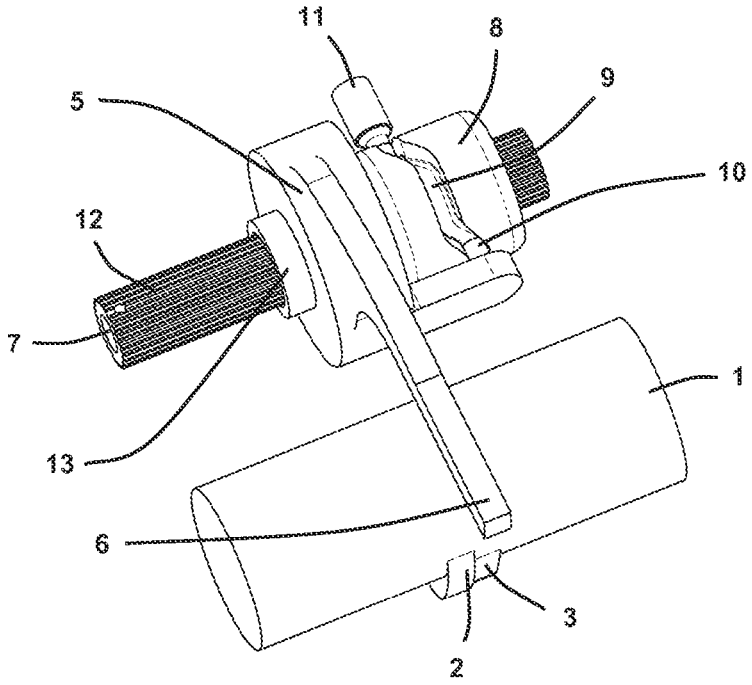
FIG. 2: shows a schematic illustration of a further advantageous embodiment of the valve train device according to the invention with an adjustment shaft extending coaxially with the lever 5.

The problem addressed by the invention is to provide a valve train device for switching the lift of gas exchange valves of an internal combustion engine, wherein the required overall space, the technical complexity and the mechanical stresses are to be reduced and operational reliability is to be increased.

An embodiment of the invention provides a device, with which the lift of gas exchange valves can be switched in a particularly advantageous manner. For this purpose, the valve train according to an embodiment of the invention is formed at least of a camshaft, a lever shaft having at least one lever mounted thereon, and an adjustment shaft.

An embodiment of the invention provides a valve train in which the gas exchange valves, in particular inlet valves and outlet valves, of an internal combustion engine are not actuated directly by a camshaft, but in which intermediate levers, in particular rocker arms or pivoting followers, are used. To switch the valve lift, adjacent cams having different cam shapes are provided on the camshaft. A displaceable lever switches between the cams and the lift of the gas exchange valves is changed according to the contour of the cams. The levers are mounted axially displaceably on a lever shaft, parallel to the camshaft. An adjustment shaft having corresponding elements for engaging with the levers is provided parallel to the camshaft and lever shaft, for switching the levers.

In an embodiment, the camshaft is mounted in a housing in a plurality of camshaft bearings so as to be rotatable, yet prevented from axial displacement. A housing is understood to be a cylinder head, a ladder frame, modules or other means for receiving a valve train. On the camshaft, a cam group is assigned to least one gas exchange valve of the internal combustion engine and consists at least of two adjacent, different cams which differ in terms of their cam shape or cam contour and/or cam protrusion. Only in the region of the base circle of the individual cams are the different cams of a cam group the same so as to allow switching between the cams during the base circle phase. The cams are connected to the camshaft for rotation therewith and are prevented from axial displacement. One of the cams of the cam group can also be formed as a zero-lift cam for valve shut-off.

In an embodiment, the lever shaft can be mounted in the housing in a plurality of bearings provided therefor so as to be rotatable and/or axially displaceable. However, the lever shaft is advantageously mounted rigidly in the housing at a constant distance from and parallel to the camshaft, so as to be non-rotatable and prevented from axial displacement. A lever is associated with each gas exchange valve and, on the one hand, is in contact with a cam of the corresponding cam group and, on the other hand, actuates the gas exchange valve directly or indirectly via at least one intermediate push rod or ram. The levers can therefore be formed as rocker arms or pivoting followers and are mounted accordingly on the lever shaft. A simple sliding bearing between lever and lever shaft can advantageously be used for this. According to the cam contour, the respective gas exchange valve is actuated by means of the translation determined by the lever. The levers are mounted on the lever shaft rotatably and axially displaceably so as to allow switching between the different cams of the respective cam group. The levers can thus carry out a pivoting, tilting or oscillating movement relative to the lever shaft.

In an embodiment, it is possible to switch between the different cams of a earn group of the associated gas exchange valve by an axial displacement of the respective lever. The displacement is implemented by means of an adjustment apparatus mounted on the adjustment shaft. The adjustment shaft is mounted in the housing so as to be rotatable, yet prevented from axial displacement, parallel to the lever shaft and camshaft. The adjustment apparatus comprises at least one sleeve, which is provided with at least one guide track and which is mounted non-rotationally, yet axially displaceably on the adjustment shaft. The guide track extends in a closed and peripheral manner over the periphery of the sleeve and progresses in a deflecting manner in the axial direction. The guide track can be formed, for example, in the form of a groove of rectangular cross-section. Other forms for the guide track are also conceivable. Furthermore, a plurality of axially spaced identical or different guide tracks can also be provided on a sleeve. The sleeve is supported on the one hand by means of a first engagement element, which is fixed to the housing and which engages permanently in the guide track of the sleeve. On the other hand, a second engagement element is used, which likewise engages permanently in the same guide track of the sleeve and is connected rigidly to the lever. If at least one further guide track is provided on the sleeve, the second engagement element can therefore also engage in this further guide track. The lever is thus positioned with respect to the housing by means of the first engagement element, which is fixed to the housing, over the guide track in the sleeve and by means of the second engagement element on the lever. If alternative forms for the guide track are used, the engagement element therefore has to be adapted in terms of its form. An engagement element is generally understood to be an element which is suitable for cooperation with the guide track and which can slide with little friction. For example, the engagement element can be formed as a dowel, pin or ball.

Due to the axial course of the guide track within the sleeve, the position of the lever with respect to the housing and therefore with respect to the camshaft is achieved with rotation of the adjustment shaft. The sleeve is supported with respect to the housing by the first engagement element, which is fixed to the housing, and is displaced axially according to the axial lift determined by the guide track. By means of the second engagement element, the axial displacement of the sleeve is transferred to the lever according to the guide track in the sleeve. The axial lift of the guide path has to be at least half the displacement path necessary to switch between two cams of a cam group. If more than two cams are provided in a cam group, wherein switching is to be implemented between said cams, the guide track in the sleeve is thus to be gradated accordingly. However, it is then only possible to switch sequentially between the cams of a cam group. The position of the engagement elements for engagement in the guide track has to be selected over the periphery of the sleeve in such a way that the guide track can produce a necessary axial lift from the point of engagement of the first engagement element to the point of engagement of the second engagement element. To this end, a minimum spacing between the engagement elements over the periphery is necessary so as to keep low the accelerations and therefore the stresses within the guide track for a switching operation. Alternatively, the radial positions of the two engagement elements can be independent of one another if two guide tracks are used. The engagement elements can then be arranged in the radial direction, for example in the same position but axially spaced according to the guide tracks.

In a particularly advantageous variant of the device according to the invention, the levers for actuating the respective gas exchange valve are arranged coaxially with the adjustment shaft. In addition to the above description of the invention, overall space and the lever shaft can thus be saved. For example, the sleeve may have a bearing region, on which the lever, which is rotatable and axially displaceable with respect to the sleeve, is mounted. Alternatively, the lever can be mounted directly on the adjustment shaft rotatably and axially displaceably, or can be positioned on the adjustment shaft by means of a separate sleeve. A particularly compact construction, which takes up less overall space, is thus provided.

Further advantages of the valve train device according to the invention for gas exchange valves of internal combustion engines will emerge from the embodiments. Individual features of the invention can be combined to form new, feasible combinations.

This variant of the valve train device according to an embodiment of the invention consists of camshaft 1 which is mounted so as to be rotatable, yet prevented from axial displacement, and on which a cam group having two axially spaced cams 2, 3 is arranged, wherein a first cam 2 of the camshaft 1 differs from a second cam 3 of the camshaft 1 in terms of its cam shape, cam contour and/or cam protrusion. A lever shaft 4 is mounted rigidly in parallel with and at a distance from the camshaft 1 so that the lever shaft 4 can neither rotate nor be displaced.

A lever 5 for actuating a gas exchange valve is slidingly mounted on this lever shaft 4. Since it is mounted slidingly, the lever 5 for actuating the gas exchange valve can be rotated on the lever shaft 4 by the camshaft 1. The lever 5 is thus in contact with one of the two cams 2, 3 of the cam group on the camshaft 1 and also has an actuation region 6, which is adapted for actuation of the gas exchange valve or of a ram. Furthermore, since the lever 5 is mounted slidingly, the lever 5 can be displaced axially on the lever shaft 4 so as to allow the lever 5 to switch between the two earns 2, 3.

The lever 5 is axially displaced by means of a sleeve 8 mounted on an adjustment shaft 7. The adjustment shaft 7 is arranged parallel to the lever shaft 4 and to the camshaft 1. The sleeve 8 mounted on the adjustment shaft 7 has an endlessly peripheral guide track 9 with an axially extending profile for generating an axial lift. A lever pin 10 is provided on the lever 5 for the axial displacement and is connected rigidly to the lever 5 and engages permanently in the guide track 9 of the sleeve 8. The sleeve 8 is also held by means of a stationary pin 11 engaging permanently in the guide track 9. Since the sleeve 8 is mounted axially displaceably, yet non-rotationally, on the adjustment shaft 7 the sleeve 8 carries out an axial lift according to the guide track 9 when the adjustment shaft 7 is rotated, due to the support at the stationary pin 11.

A multi-tooth guide 12 is provided on the adjustment shaft 7 for the bearing of the sleeve 8 and can be used to transfer a torque required for a switching operation. Furthermore, the multi-tooth guide 12 enables an axial displacement of the sleeve 8, which is produced by the guide track 9 and the supporting stationary pin 11. The sleeve 8 is supported on the one hand by means of the guide track 9 and the stationary pin 11, for example with respect to a housing, and is displaced axially by rotation of the adjustment shaft 7, this displacement also being transferred to the lever 5 by means of the lever pin 10. The lever 5 is accordingly displaced axially so as to thus switch between the cams 2, 3 to switch the lift of gas exchange valves.

In a particularly advantageous variant of the valve train device according to an embodiment of the invention consists of a camshaft 1, which is mounted so as to be rotatable, yet prevented from axial displacement, and on which a cam group having two axially spaced cams 2, 3 is arranged, wherein a first cam 2 of the camshaft 1 differs from a second cam 3 of the camshaft 1 in terms of its cam form, cam contour and/or cam protrusion. An adjustment shaft 7 is rotatably mounted in parallel with and at a distance from the camshaft 1.

A sleeve 8 is mounted non-rotationally, yet axially displaceably on the adjustment shaft 7 by means of a multi-tooth guide 12. The sleeve 8 has an endlessly peripheral guide track 9 having an axially extending profile for producing an axial lift. Furthermore, a lever 5 for actuating a gas exchange valve is arranged coaxially on the adjustment shaft 7. The lever 5 is mounted rotatably and axially displaceably relative to the adjustment shaft 7. To this end, either a separate bearing sleeve 13 is provided for the lever 5 and is guided on the adjustment shaft 7 by means of the multi-tooth guide 12 and receives the lever 5 by means of a sliding bearing, or a sliding bearing region is provided on the sleeve 8, on which the lever 5 is mounted rotatably and axially displaceably relative to the sleeve 8. According to the invention, the lever 5 is advantageously mounted on a hearing region of the sleeve 8 for this embodiment.

A lever pin 10 is provided on the lever 5 for the axial displacement and is connected rigidly to the lever 5 and permanently engages the guide track 9 of the sleeve 8. The sleeve 8 is also held by means of a stationary pin 11 engaging permanently in the guide track 9. Since the sleeve 8 is mounted axially displaceably, yet non-rotationally on the adjustment shaft 7, the sleeve 8 carries out an axial lift according to the guide track 9 when the adjustment shaft 7 is rotated, due to the support at the stationary pin 11.

Since it is mounted slidingly, the lever 5 for actuating the gas exchange valve can be rotated on the sleeve 8 by the camshaft 1. The lever 5 is thus in contact with one of the two cams 2, 3 of the cam group on the camshaft 1 and also has an actuation region 6, which is adapted for actuation of the gas exchange valve or of a rain. Furthermore, since the lever 5 is mounted slidingly on the bearing region of the sleeve 8, the lever 5 can be displaced axially so as to allow the lever 5 to switch between the two cams 2, 3.

The lever 5 is axially displaced by means of the sleeve 8. The sleeve 8 is supported by means of the guide track 9 and the stationary pin 11, for example with respect to a housing and is displaced axially by rotation of the adjustment shaft 7, this displacement also being transferred to the lever 5 by means of a lever pin 10. The lever 5 is accordingly displaced axially so as to thus switch between the cams 2, 3 to switch the lift of gas exchange valves.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1 camshaft
2 first cam
3 second cam
4 lever shaft
5 lever
6 actuation region
7 adjustment shaft
8 sleeve
9 guide track
10 lever pin
11 stationary pin
12 multi-tooth guide
13 bearing sleeve

What is claimed is:

1. A valve train device for switching a lift of gas exchange valves of an internal combustion engine comprising:
- a camshaft;
- a cam group including at least two cams disposed on the camshaft;
- at least one lever mounted axially displaceably relative to the camshaft and in contact with one of the at least two cams and includes an actuation region for a direct or indirect actuation of at least one gas exchange valve; and
- an adjustment unit operatively connected to the lever so as to displace the lever and including:
  - at least one rotatable adjustment shaft,
  - at least one sleeve having at least one guide track mounted on the shaft non-rotationally and axially displaceably,
  - an engagement element fixed to a housing and engaging permanently in the at least one guide track and supporting the at least one sleeve with respect to the housing, and
  - a further engagement element offset radially along the guide track with respect to the engagement element and engaging permanently in the at least one guide track and connected rigidly to the lever.

2. The valve train device as recited in claim 1, further comprising a lever shaft spaced apart parallel from the camshaft, wherein the lever is mounted on the lever shaft.

3. The valve train device as recited in claim 1, wherein the lever is mounted coaxially with the adjustment shaft so as to be axially displaceable and rotatable.

4. The valve train device as recited in claim 3, wherein the lever is disposed coaxially with the adjustment shaft on the sleeve in a region of a bearing.

5. The valve train device as recited in claim 3, wherein the lever is disposed coaxially with the adjustment shaft on a separate bearing sleeve.

6. The valve train device as recited in claim 1, wherein the lever is configured as one of a rocker arm and a pivoting follower.

7. The valve train device as recited in claim 1, wherein the engagement element is configured as one of a ball and a dowel.

8. The valve train device as recited in claim 1, wherein the guide track is configured at least in part as a groove, and wherein the engagement element is configured at least in part as a round dowel.

9. A valve train device for switching a lift of gas exchange valves of an internal combustion engine comprising:

a camshaft;

a cam group including at least two cams disposed on the camshaft;

at least one lever mounted axially displaceably relative to the camshaft and in contact with one of the at least two cams and includes an actuation region for a direct or indirect actuation of at least one gas exchange valve; and an adjustment unit operatively connected to the lever so as to displace the lever and including:

at least one rotatable adjustment shaft, at least one sleeve having at least two guide tracks mounted on the shaft non-rotationally and axially displaceably, an engagement element fixed to a housing and engaging permanently in a first of the at least two guide tracks and supporting the at least one sleeve with respect to the housing, and a further engagement element engaging permanently in an axially spaced further guide track of the at least two guide tracks, the lever being supported directly or indirectly in the axially spaced further guide track.

10. The valve train device as recited in claim 9, wherein the lever is mounted coaxially with the adjustment shaft so as to be axially displaceable and rotatable.

11. The valve train device as recited in claim 10, wherein the lever is disposed coaxially with the adjustment shaft on the sleeve in a region of a bearing.

12. The valve train device as recited in claim 10, wherein the lever is disposed coaxially with the adjustment shaft on a separate bearing sleeve.

13. The valve train device as recited in claim 9, wherein the lever is configured as one of a rocker arm and a pivoting follower.

14. The valve train device as recited in claim 9, wherein the engagement element is configured as one of a ball and a dowel.

15. The valve train device as recited in claim 9, wherein the first guide track is configured at least in part as a groove, and wherein the engagement element is configured at least in part as a round dowel.

* * * * *